US006708362B1

(12) United States Patent
Allen

(10) Patent No.: US 6,708,362 B1
(45) Date of Patent: Mar. 23, 2004

(54) LOAD BEARING CONCRETE PANEL CONSTRUCTION

(76) Inventor: John H. Allen, 4269 D Monroe Dr., Boulder, CO (US) 80303

( * ) Notice: Subject to any disclaimer, the term of this patent is extended or adjusted under 35 U.S.C. 154(b) by 576 days.

(21) Appl. No.: 08/430,311

(22) Filed: Apr. 28, 1995

Related U.S. Application Data

(63) Continuation of application No. 07/653,767, filed on Feb. 11, 1991, now abandoned, which is a continuation-in-part of application No. 07/299,618, filed on Jan. 23, 1989, now Pat. No. 4,991,248, which is a continuation-in-part of application No. 07/193,948, filed on May 13, 1988, now abandoned.

(51) Int. Cl.[7] ..... E01C 7/00
(52) U.S. Cl. ..... 14/73; 404/70; 404/82
(58) Field of Search ..... 14/1, 17, 73; 404/70, 404/73, 82; 52/309.16, 309.17, 334, 602, 659, 743, 745; 428/247, 913; 264/31, 34, 35; 106/644

(56) References Cited

U.S. PATENT DOCUMENTS

| | | | | | |
|---|---|---|---|---|---|
| 983,274 | A | * | 2/1911 | Graham | 52/659 |
| 1,891,763 | A | * | 12/1932 | Henderson | 52/334 X |
| 2,179,019 | A | * | 11/1939 | Willetts | 404/70 X |
| 2,220,349 | A | * | 11/1940 | Plumb | 52/600 X |
| 2,850,890 | A | * | 9/1958 | Rubenstein | 52/309.17 X |
| 3,429,094 | A | * | 2/1969 | Romualdi | 52/659 X |
| 3,650,785 | A | * | 3/1972 | Ball et al. | 106/90 |
| 3,808,085 | A | * | 4/1974 | Givens, Jr. | 52/659 X |
| 3,852,930 | A | * | 12/1974 | Naaman | 52/659 X |
| 3,986,885 | A | * | 10/1976 | Lankard | 106/99 |
| 4,159,361 | A | * | 6/1979 | Schupack | 428/247 X |
| 4,319,854 | A | * | 3/1982 | Marzocchi | 404/70 X |
| 4,379,870 | A | * | 4/1983 | Matsumoto | 52/659 X |
| 4,565,840 | A | * | 1/1986 | Kobayashi et al. | 52/659 X |
| 4,604,841 | A | * | 8/1986 | Barnoff et al. | 14/73 X |
| 4,700,519 | A | * | 10/1987 | Person et al. | 52/334 |
| 4,706,319 | A | * | 11/1987 | Sivachenko et al. | 14/73 |
| 4,785,600 | A | * | 11/1988 | Ting | 52/334 |
| 4,991,248 | A | * | 2/1991 | Allen | 14/73 |

FOREIGN PATENT DOCUMENTS

| | | | | |
|---|---|---|---|---|
| DE | 3342626 | * | 6/1985 | 14/73 |
| GB | 578036 | * | 6/1946 | 404/70 |
| JP | 2141206 | * | 6/1987 | 14/73 |

OTHER PUBLICATIONS

Letter of award from the American Society of Civil Engineers, May 1997.*

"Fiber Reinforced Concrete for Exterior Slabs–on–Grade, Part I,"; byTrottier et al; Concrete International, Jun. 1997.*

(List continued on next page.)

*Primary Examiner*—Hoang Dang
(74) *Attorney, Agent, or Firm*—Sheridan Ross P.C.

(57) ABSTRACT

Prior art supported, load bearing concrete panels having flexural reinforcing materials within the top and bottom halves, are over-designed, and experience increased deterioration and increased severity of cracks in the top surface due to flexural reinforcing materials which are located within the top half of the panel. It is now taught that, by removing flexural reinforcing materials which are intended to carry carrying bending moment tension stresses in the top half of panels (12), over supports (14), while maintaining such flexural reinforcing materials (20) confined to the lower half of the panel, does not reduce the flexural strength of the panel (12) below that which is required to support expected loads. Such panels (12), without flexural reinforcing materials in the top half, exhibit improved durability and reduced top surface (16) cracking, and can be produced with fewer production steps and with reductions in the cost of materials. Preferred techniques for controlling top half cracking from temperature and shrinkage of the panel are also set forth.

16 Claims, 4 Drawing Sheets

OTHER PUBLICATIONS

"Behavior of RC Bridge Deck with Flexible Girders"; Journal if Structural Engineering, American Society of Civil Engineers,, Jan. 1996.*
"Bridge Decks Minus Top Bars Enhance Long Term Durability," John Allen, Jan. 1996.*
Sessin Program portions from the 75th Meeting of the Transportation Research Board, Washington, D.C.*
Case Study of Concrete Deck Behavior in a Four–Span Prestressed Girder Bridge: Final Report, Report No. CDOT–DTD–UCB–95–16, Colorado Department of Transportation, Sep. 1995.*
ACI Building Code Requirements for Reinforced Concrete, 318–56, Section 104, Definitions, p. 3.*
AASHTO bridge code Sections 8.16.3.1, 8.17.1.1 & 8.20.*
Third Bridge Engineering Conference, Transportation Research Record 1290, p. 154.*
Structural Design Guide to the ACI Building Code, Rice and Hoffman, 1979, p. 33.*
NCHRP 297, Evaluation of Bridge Deck Protective Strategies, 1987, pp. 4–5.*
ASTM C–1018–85, Standard Test Method of Flexural Toughness and First Crack Strength of Fiber–Reinforced Concrete (Using Beam with Third–Point Loading).*
ASTM C–1116–89, Standard specification for Fiber–Reinforced Concrete and Shotcrete.*
Letter from A.J. Siccardi, colorado DOT, Mar. 1990.*
Letter from G. Anderson, Washington DOT, Apr. 1995.*
News item "Emerging Technology", Dec. 1994.*
News article published in the Denver Post, Jan. 1995.*
"FRC Deck Slabs Without Tensile Reinforcement," B. Bakht and A. A. Mufti, Contrete International, Feb. 1996.*
"Standard Specification for Highway Bridges", Fourteenth Edition, 1989, American Association of State Highway and Transportaion Officials, pp. 57, 66, 71 and 80.*
"Building Code Requirements for Structural Plain Concrete" (Revised 1987), Reported by ACI Committe 318, 7 pages.*
"Building Code Requirements for Reinforced Concrete (ACI 318–89) and Commentary –ACI 318R–89", Reported by ACI Committe 318, Nov. 1989, 8 pages.*

* cited by examiner

LOAD BEARING CONCRETE PANEL CONSTRUCTION

RELATED APPLICATIONS

This application is a continuation of U.S. patent application Ser. No. 07/653,767,filed Feb. 11, 1991 now abandoned, which continuation-in-part of U.S. patent application Ser. No. 07/299,618, filed Jan. 23, 1989, which is now U.S. Pat. No. 4,991,248, issued Feb. 12, 1991, which was in turn a continuation-in-part of U.S. patent application Ser. No. 07/193,948, filed May 13, 1988, and now abandoned.

BACKGROUND OF THE INVENTION a.) Field of the Invention

The present invention relates generally to static structures. More specifically, it relates to concrete panel structures in a form which is useful for trusses, structural floors, or for use in bridge decks. The present invention also relates to methods of producing concrete panels for use in trusses, structural floors and bridge deck structures.

b.) Description of the Prior Art

Typically, traffic bearing floors on bridges are constructed using concrete bridge deck panels supported by a specifically designed substructure. Such concrete panels are normally at least six inches thick, and are continuous over at least a pair of separated support members, such as beams, which beams extend longitudinally in the same direction as what is defined herein as the length of the panels bridge span. State-of-the-art concrete bridge deck panel construction has traditionally been comprised of a slab constructed of one layer or more than one layer of concrete having a "flexural reinforcing structure" distributed throughout the concrete layer. Such a "flexural reinforcing structure" is generally in the form of a matrix of overlapping steel reinforcing bars (re-bars) or steel strands, which are spaced from both the upper surface and the lower surface of the concrete deck panel. In accordance with traditional practice, this flexural reinforcing structure is included in the concrete for the purpose of carrying bending moment tension stresses which are placed on the concrete panel due to loading and unloading of the top surface, for example, by the passage of vehicles on, or adjacent to, the top surface of the panel.

It has traditionally been believed that structural flexural reinforcing material such as steel reinforcing bars (re-bars), are required throughout the concrete of such a panel, and especially in groups in the top and bottom halves of the panel near both the top surface and bottom surface of the panel. In the current state-of-the-art, it is believed to be necessary to use both top and bottom structural flexural reinforcing material re-bars in order to restrain cracking of the top surface and of the bottom surface due to applied loads. The traditional art of bridge deck design and construction has been governed by AASHTO (American Association of State Highway and Transportation Officials). The 1989 Edition of the AASHTO Standard Specification for Highway Bridges specifies the minimum thickness of bridge deck 6.5 inches.

The lower group of flexural reinforcing material in the bottom half of a bridge deck panel normally consists of a first plurality of re-bars which form a layer. This first plurality of re-bars are transverse to both the length dimension of the panel and to the load-carrying beams on which the panel is supported. For structural purposes, this lower layer of transverse flexural materials (re-bar) carries the positive moment tensile stresses which are applied to the panel. A second lower layer of flexural reinforcing material, normally consisting of a second plurality of re-bars which are parallel to both the length dimension of the panel and to the load-carrying, support beams (and transverse to the first lower layer of re-bars) is located directly above the first lower layer of re-bars. For structural purposes this second lower layer of flexural reinforcing material re-bars distributes the bending moment loads which are applied to the panel longitudinally. Both lower layers of flexural reinforcing material re-bars provide control of temperature and shrinkage cracking at the lower surface of the panel as the minimum amount required for temperature and shrinkage reinforcement is less than the minimum required amount of flexural reinforcing for reinforced concrete. Under current codes, for most support beam spacings, which are up to about eleven feet apart, the longitudinal bottom group of flexural reinforcing material constitutes from about one-half to about two-thirds of the main reinforcement of the panel. The two lower layers of flexural reinforcing material are usually joined together, for example with wire, to form a mat or matrix.

Further, in accordance with current practice, another group of main flexural reinforcing material is located in the top half of the panel near the upper surface of the concrete panel. It normally consists of a first upper layer comprised of a plurality of flexural reinforcing materials, normally re-bar, which are designed to carry the negative moment tensile stresses which are applied to the panel, and a second upper layer normally immediately below the first upper layer and oriented transversely to the first upper layer comprised of a plurality of flexural reinforcing material which are intended for control of temperature change and concrete volume shrinkage cracking and to hold the uppermost flexural reinforcing materials in position during concrete placement. Both upper layers of flexural reinforcing material re-bars are intended to provide control of temperature shrinkage cracking at the upper surface of the panel. In addition to their function as flexural reinforcing, the first upper layer of re-bars is intended to provide control of temperature and shrinkage cracking at the upper surface of the panel. The upper group of flexural reinforcing materials is also usually in the form of a mat or matrix, which matrix is sized and oriented substantially identical to, and also parallel to, the flexural reinforcing matrix group in the lower half of the concrete panel.

Flexural reinforcing materials composed of steel re-bars, which re-bars are not coated or connected to a sacrificial anode, corrode readily when exposed to thawing salts and other corrosive elements, and even to ordinary water.

Despite the above described traditional flexural reinforcing of concrete bridge deck panel structures, concrete bridge deck panels have been found to deteriorate rapidly and to require costly rehabilitation or replacement from time-to-time. It has been recently estimated, for example, that the use of thawing salts on bridges in the United States causes $1.6 billion dollars worth of damage annually. Similar problems exist outside of the United States. Thus, there is a world-wide need to reduce the deterioration of concrete bridge deck panels without reducing the ability of the bridge deck panels to resist moment stresses imposed thereon by traffic loads.

It has been determined that much of the deterioration of concrete bridge deck panels is actually attributable to the corrosion of the traditional flexural reinforcing bars in the upper half of such bridge deck panels. It had been the common practice, until the late 1960's, to construct most concrete bridge deck panels over girder bridges with the bottom flexural reinforcing bars bent up over the supporting elements, such as beams or girders. Because of their shape, such bent flexural strength reinforcing bars are sometimes referred to as "crank bars," because they resemble crankshafts. In the late 1960's the use of thawing salts on roads became quite prevalent. Subsequently the use of a greater amount of continuous straight flexural reinforcing re-bars in the top half of the concrete panel replaced the use of crank bars, because it was found to be more cost efficient to use more flexural reinforcing bars in the top half, than to bend and place crank bars in the lower half. This practice also helped maintain the proper position of the bars in the top mat. As a result, this practice substantially increased the amount of corrodible steel re-bar material in the top of the deck panel. Bridge deck panels of this era were also constructed with only about 1.5 inches (3.8 cm) of protective concrete cover over the continuous straight top bars or re-bars.

During the early 1970's, the protective concrete cover over the top re-bars was generally increased to greater than about 2 inches (5.1 cm). At the same time, construction practices were improved so that reduction of the thickness of the top cover during panel placement, was avoided. It was believed that the additional thickness of the top concrete cover would limit or slow cracking of the top surface, and thus lengthen the time that it took for chlorides from thawing salts and other corrosive elements to penetrate to the level of the re-bars contained in the upper portion of the concrete panel.

The understanding that chlorides from thawing salts and other corrosive materials corrode the re-bars in the upper half of the concrete panel, and thus constitute the source of significant cracking and deterioration of the top surface of the bridge deck panel is important to the present invention, as set forth below.

Surprisingly, the additional thickness of concrete top cover included in bridge deck panel designs during the 1970's did not extend bridge deck panel life significantly. Subsequently, in most jurisdictions in which thawing salt is used, it became the practice to take steps to make bridge deck panels more impervious to the penetration of moisture, salt and other corrosive materials. It was believed that if the salt and other corrosive materials could not reach the re-bars in the upper half of the concrete layer, that the corrosion problem would be solved. Consequently, richer concrete mixes which were known to be more impervious to salts than traditional concrete mixes were utilized, and as a result the use of concrete having greater load bearing strengths then became standard practice. However, the use of richer concrete mixes led to yet another problem, in that such concrete exhibited increased shrinkage characteristics.

It is believed that the increased shrinkage of the used richer concrete mixes may be primarily, or at least partly, responsible for additional cracks developing in the top surface of the concrete in recently constructed concrete deck panel structures. Of course, such cracks allow thawing salts and other corrosive materials to reach the corrodible re-bars in the upper half of the concrete panel and cause them to corrode, and thereby cause deterioration of the panel.

It is also known that cracking in the upper surface of concrete bridge deck panels can be avoided by careful control of the concrete mix and by concrete placement techniques. However, to be successful, such a strategy requires careful selection and proportioning of concrete mix materials, and meticulous concrete placement and curing practice. These techniques have not been widely employed as part of a bridge deck construction strategy because it was thought that control of negative moment stresses in the upper surface of bridge decks was the dominate requirement for the restraint of cracking in the upper surface.

Several barrier technologies have been developed to stop or limit corrosion of flexural reinforcing re-bar materials which are located in the top half of concrete bridge deck panels from contact with thawing salts and other corrosive materials. Such barrier technologies include, for example, surface membranes, dense concrete, latex modified concrete, epoxy coated re-bars and the like. These barrier systems have had only moderate success.

Epoxy coated re-bars have proven to provide the most satisfactory corrosion protection, since such epoxy coatings, if continuous, virtually eliminate all actual contact between the re-bars and the thawing salts or other corrosive materials. However, it will be recalled that such re-bars are normally installed as matrices, which are often connected by tie wires and chains to the re-bar matrix in the lower portion of the concrete. The connecting tie wires and chains are usually electrically conductive. It has been found that placing a matrix of epoxy coated re-bars in the upper half of the concrete panel into electrical connection with the uncoated matrix of re-bars in the lower half of the panel allows an electrical half-cell to develop which encourages corrosion of the upper matrix of epoxy coated flexural reinforcing material. Additionally, epoxy coating re-bars apparently do not bond with the concrete in the panel as well as uncoated re-bars. Therefore, when epoxy coated re-bars are used in the top half of a concrete panel, once surface cracking is initiated, the length and width of cracks in the top surface tend to be larger than they would be had uncoated re-bars been used.

Waterproofing membrane barrier systems have been coated on the top surface of concrete panels. One potential problem with such waterproofing membrane barrier systems is that, should any moisture manage to migrate or collect below the membrane, it creates a closed, moisture retaining environment in which corrosion can occur, whether or not salts or other corrosive materials are present. Furthermore, such barrier systems may conceal the deterioration of the top of the concrete from view, thereby delaying remedial maintenance until deterioration has become quite severe.

The above sequence of developments in the prior art of concrete bridge deck panels has been extremely costly. The combined effects of the additional thickness of the concrete, the use of epoxy coated re-bars in the upper portion of the bridge deck panel, the coating of waterproofing membrane systems on the top surface, and the increased girder weight necessary to carry the greater deadload of thicker deck panels, have all increased the cost of bridge deck panel systems by as much as about 30% to about 50%. Furthermore, despite the recognition of the problems caused by the corrosion of upper half flexural reinforcing re-bar,and the various technologies which have been developed to combat them, and even with the increased cost, deterioration of bridge deck panels still is a problem which has not been satisfactorily resolved.

Recently, a great deal of research has been conducted in an effort to develop means to protect the flexural reinforcing bar matrix in the top half of the panels from the effects of corrosion. The effectiveness of these efforts has been reported in National Cooperative Highway Research Program Report #297(NCHRP 297), *Evaluation of Bridge Deck Protective Strategies*, September, 1987.

In other known prior art, Mingolla U.S. Pat. No. 4,271,555 and Barnoff U.S. Pat. No. 4,604,841 are both examples of bridge deck panel structures which attempt to overcome certain problems of construction. However, while there are certain novel features to these particular deck panel constructions, both of them use conventional flexural reinforcing steel bar materials near both the upper as well as the lower surface of the deck panel structure.

Other patents which have recently been awarded for bridge deck protection systems, include Jacobs U.S. Pat. No. 4,151,025; U.S. Pat. No. 4,708,888; and Marzocchi, U.S. Pat. No. 4,319,854. They teach, respectively, a membrane barrier system, an electro-chemical "cathodic protection" system, and a combination membrane and electro-chemical system.

Through various research efforts, it has been found that transverse cracking generally occurs at the top surface of the panel substantially directly over the layer of transverse flexural reinforcing re-bars which are in the top half of a bridge deck panel. Such cracks are a significant factor in the deterioration of bridge deck panels, since, as already noted, they allow salts, other corrosive elements, and water to reach the flexural reinforcing bars which are in the top half of the panel and cause them to corrode, thereby accelerating deterioration of the panel. Surprisingly, these cracks form at about right angles to the direction that they would be expected to form if they were due to the stresses caused by the predicted bending moments to which the panel is subjected. However, it is now noted that the observed crack patterns are consistent with tensile stresses due to concrete shrinkage and the effects of temperature changes. This indicates that the control of the formation of transverse cracks directly over the top transverse reinforcing bars due to concrete shrinkage and temperature changes at the surface of bridge deck panels is of paramount importance in avoiding deck panel deterioration. However, effective means for its avoidance are not known to have been previously proposed.

It is well known that the use of either fibers or fabric serves to effectively control upper surface cracking due to volume changes from temperature and shrinkage in structural plain concrete. Such reinforcement materials can be used, in at least the concrete which forms the uppermost portion of a bridge deck panel, to control surface cracking caused by temperature shrinkage changes. It does not require careful control of the concrete mix, nor careful placement of the concrete in order to be successful. Romauldi U.S. Pat. No. 3,429,094 and Kobayashi U.S. Pat. No. 4,565,840 teach the use of fiber reinforcement materials for crack control in concrete. The use of various fiber materials for the reinforcement of concrete is discussed in the Manual of Concrete Practice, ACI. The use of fiber reinforcement materials to restrain cracking due to changes from temperature shrinkage has now become more common than the well established practice of using steel welded wire fabric reinforcement materials for such purposes, see Romauldi U.S. Pat. No. 3,429,094. Fiber or welded wire fabric reinforcing for the purposes of temperature and shrinkage crack control is not used in a sufficient quantity to increase the flexural strength of the concrete, and does not bring it to a level which is defined as "reinforced concrete". Shrinkage and temperature crack control reinforcing means such as fibers and welded wire fabric thus used, should not to be confused with, nor considered to be "flexural reinforcing material" or "flexurally reinforced".

Givens U.S. Pat. No. 3,808,085 describes a reinforced concrete structural member for use as in bridge decking which employs fibers as the upper flexural stress reinforcing means, while retaining conventional steel bar flexural reinforcing means for the lower stress reinforcing. In order to provide the upper flexural stress reinforcing means thought to be necessary, Givens improved upon the art made known by Romauldi, cited above, by utilizing more closely spaced short steel wire fibers in the concrete matrix. Although Givens does improve upon the crack resistance of the upper concrete surface, in order to achieve the presumed to be required flexural strength, this is disadvantageous because a greater volume of expensive steel wire fibers are needed to replace the less expensive steel bar reinforcing utilized in conventional art. A further disadvantage of Givens is that a greater volume of corrodible wire fiber material is thereby placed in the upper portion of the slab where they are readily subject to corrosion. Another disadvantage of Givens is that the concrete with a high volume of wire fiber becomes substantially more difficult to mix and place properly.

Givens does not recognize that stress reversal over the interior girders does not occur in accordance with the heretofore known state of the art. Nor does Givens recognize that the primary cracking problem in the upper surface of bridge decks is associated with temperature and shrinkage cracking and corrosion of the upper flexural reinforcing bars. Thus, Givens claims a reinforced concrete structure with both upper and lower stress reinforcing means, wherein the upper stress reinforcing means are wire fibers. Givens specifically discloses an improvement in which fibrous concrete having the same strength as a conventional structure using steel bar reinforcing means is provided. The present invention, as described below, differs from Givens in that the adverse effects of panel deterioration are avoided by using, in some embodiments, only sufficient fiber reinforcing means to adequately control temperature and shrinkage crack formation utilizing specially formulated plain concrete in the upper portion of the panel.

Structural plain concrete differs from reinforced concrete in that plain concrete is assumed to carry all the flexural tensile bending stress with no stress carried by reinforcing materials that may be present. In accordance with the definition for reinforced concrete in "*Building Code Requirements for Reinforced Concrete* (*ACI* 318–89) *and Commentary*", the concrete is assumed to carry no tensile stress, all tensile stress being carried by the reinforcing bars, so that the flexural load bearing capacity is not considered to be diminished after cracking.

Also noted as of interest are Graham U.S. Pat. Nos. 865,490 and 983,274; Henderson U.S. Pat. No. 1,891,763; Rubenstein U.S. Pat. No. 2,850,890; Naaman U.S. Pat. No. 3,852,930; Schupack U.S. Pat. No. 4,159,361; and Matsumoto U.S. Pat. No. 4,379,870; as well as U.K. Patent 578,036; Japanese Patent 2,141,206; and German Patent 3,342,626. Of these, Graham U.S. Pat. Nos. 865,490 and 983,274 disclose a reinforced concrete slab which is designed and intended for placement on the ground. These references includes reinforcing rods in the bottom half, with the latter of these references including the addition of what appears to be a high volume of short wire sections in the upper portion of the concrete to increase the strength of the slab. Because of the size and volume of the wire sections they are added by placing them on top of the concrete and allowing them to settle into the concrete rather than being mixed with the concrete. Graham neither teaches nor suggests a load bearing panel intended to be placed on two or more spaced apart supports, and in the more than eighty years since its filing, its application to load bearing panel construction technology is not known to have occurred.

Schupack U.S. Pat. No. 4,159,361 discloses cold formable, reinforced panel structures which include shrinkage and thermal reinforcement fibers. Schupack neither teaches nor suggests a load bearing panel which is intended to be placed on two or more spaced apart supports, nor a panel which includes flexural reinforcing material, and its application to load bearing panel construction technology is neither taught nor suggested. Matsumoto U.S. Pat. No. 4,379,870 discloses a specific form of synthetic resin reinforcement material which has utility in concrete structures, but it neither teaches nor suggests a load bearing panel which is intended to be placed on two or more spaced apart supports, nor a panel which includes flexural reinforcing material, and its application to load bearing panel construction technology is neither taught or suggested.

It is important to here note that "reinforcement material" as used throughout this application is different from "flexural reinforcing material," such as traditional steel re-bars.

SUMMARY OF THE INVENTION

Accordingly, it is a principal object of the present invention to provide a load bearing concrete panel which is significantly less expensive then existing panels due to the removal of materials which are now used in state-of-the-art load bearing concrete panels without loss of the utility of such panels, and, in fact, with improved durability of the resulting panels.

A further object of the present invention is to provide a method of making load bearing concrete panels which requires less steps and which is significantly less expensive than existing panels due to the elimination of steps which are now used in the state-of-the-art process for producing load bearing concrete panels without loss of the utility of such panels, and, in fact, with improved durability of the resulting panels.

Yet another object of the present invention is to provide a concrete bridge deck panel structure which has sufficient flexural reinforcement to provide the appropriate amount of flexural strength, while also being designed to eliminate or at least significantly impede both the amount and the speed of surface deterioration of the deck panel Still yet another object of the present invention is to provide a concrete bridge deck panel structure in which structural flexural reinforcing material, such as steel reinforcing bars, are not required in the top half of the panel near the top surface of the panel between the exterior girders.

Another object of the present invention is to provide a concrete bridge deck panel structure in which very little structural flexural reinforcing material composed of steel need be epoxy coated or connected to a sacrificial anode in order to prevent corrosion of such flexural reinforcing material.

It is yet another object of the present invention to provide a concrete bridge deck panel structure in which chlorides from thawing salts and other corrosive materials do not corrode re-bars in the upper half of the concrete panel with the avoidance of a source of significant cracking and deterioration of the top surface of the bridge deck panel.

It is yet another object of the present invention to provide a concrete bridge deck panel structure in which the source of significant cracking and deterioration of the top surface of the bridge deck panel, and consequent less of structural integrity of such a panel, due to corrosion of the steel reinforcing bars in the upper half of the concrete panel from chlorides from thawing salts and other corrosive materials is substantially avoided.

Yet a further object of the present invention is to provide a concrete bridge deck panel structure in which increased concrete volume shrinkage due to the use of richer concrete mixes is avoided.

Still yet another object of the present invention is to provide a crack and corrosion resistant concrete bridge deck panel without reducing the ability of the bridge deck panel to resist moment stresses imposed thereon by traffic loads.

Another object of the present invention is to provide a bridge deck panel which resists cracking at the upper surface of the panel due to concrete volume shrinkage and temperature changes.

A further object of the present invention is to provide a load bearing concrete panel structure having improved structural properties which prevent or reduce deterioration of the top surface of the panel caused by corrosion of flexural reinforcing materials.

It is a further object of the present invention to provide a load bearing concrete panel structure having improved structural properties which eliminate the cracking or deterioration of the top surface of the panel caused by corrosion stress from transverse flexural reinforcing materials.

Still yet another object of the present invention to provide a concrete bridge deck panel structure having improved structural properties which prevent or reduce deterioration of the top surface of the panel due to temperature and shrinkage volume changes at the top surface.

Another object of the present invention is to provide a concrete panel for use in new bridge construction as well as a process for producing such concrete panels and also for use in rehabilitating existing panel structures, which panel design reduces the corrosion characteristics of the top half and top surface of the panel.

Yet another object of the present invention is to provide a concrete panel design for use in new bridge construction and in rehabilitating existing bridge panel structures, which panel design inhibits deterioration of the top surface of the panel due to temperature and shrinkage volume changes at the top surface.

The invention being taught is a load bearing concrete panel structure which uses structural plain concrete for at least the upper portion of the panel, which concrete has, in preferred embodiments, been specially formulated and installed in a manner to resist temperature change and concrete shrinkage cracking at the upper surface, and which relies on flexural reinforcing materials, such as standard flexural reinforcing bars, being confined to the lower half of the panel to carry superimposed loads.

As discussed in detail above, substantially all known efforts previous hereto to reduce the problem of the corrosion of flexural reinforcing materials have been defensive in nature. That is they have either sought to isolate top flexural reinforcing material from corrosive compositions, for example by the provision of a greater amount of concrete top cover or a water proof membrane on the concrete above the top flexural reinforcing re-bars, or by epoxy coating the re-bars, or they have used electro-chemical methods, such as cathodic protection. However, these solutions do not deal with or solve what is now recognized by the present invention to be a two-fold problem with existing bridge deck panel designs. It is now recognized that problems of panel deterioration and top surface cracking are caused by the flexural reinforcing materials, such as corrodible re-bars, which are located within the top half of the concrete panel, and especially such flexural reinforcing materials which are near the top surface of the panel, and oriented transversely, and which are often coated with epoxy. This is due to the fact that the flexural reinforcing materials which are in the top surface of the panel are subject to corrosion and accelerate degradation of the surface of the panel, and those which are near the top surface of the panel and oriented transversely have now been determined to accelerate the widening and increase the severity of cracks in the top surface due to temperature and concrete shrinkage changes.

Having recognized the above enumerated problems, the present invention, suggests new solutions which are quite different from the defensive solutions utilized in prior and current deck panel designs. It is now postulated that the current practice of placing corrodible flexural reinforcing materials, such as steel re-bars, in the upper half of a concrete bridge deck panel, and especially transversely oriented flexural reinforcing materials which are near the top surface of the panel, is far more detrimental than beneficial to the long term performance and life of the panel. It is therefore concluded that the use of flexural reinforcing materials, and especially of steel reinforcing bars in the top half of a bridge deck panel, as currently practiced, adversely affects the durability of the panel.

Elaborating, this postulate is based on the facts and assumptions that: 1) transversely oriented flexural reinforcing materials, such as reinforcing bars, apparently contribute to increased transverse crack formation due to temperature induced concrete shrinkage at the surface of the panel; 2) when corrodible flexural reinforcing materials in the upper half of a bridge deck panel are exposed to corrosion causing materials and solutions, they corrode and thereby accelerate the deterioration of the surface and the top half of the panel; 3) flexural reinforcing materials, are not required in the top half of a panel for structural strength of the panel; and 4) under standard practices, adequate amounts and distributions of flexural reinforcing materials are present in the bottom half of the panel to provide sufficient flexural strength to the panel.

It has therefore now been discovered, in accordance with the present invention, that the placement of transverse reinforcing bars in the upper portion of bridge deck panels is not required between the exterior supports of concrete panels continuous over two or more supports to provide adequate structural strength to such panels, and that the top layer of longitudinal flexural reinforcing re-bar is not effective in controlling cracking of the upper surface. It has further been discovered, in accordance with the present invention, that the placement of any flexural reinforcing materials in the upper half of bridge deck panels is not required in the region between the exterior support beams to provide adequate structural strength to such panels. It is further postulated that various crack control practices at the upper surface of deck panels should be the governing design criterion for crack control at the top surface of bridge deck panels, and that flexural reinforcing materials should be confined to the lower portion of the bridge deck panel.

Crack control of the upper surface of the deck panels can be further improved using several practices. First, and most preferably, concrete mix compositions can be used which resist surface cracking associated with changes due to temperature and shrinkage design. properties, and such concrete compositions should be the subject of careful placement practice and curing. A second manner of improving crack control at the upper surface of a deck is by the use of fibrous reinforcement materials, preferably in the upper quarter to one-half of the panel. A third manner of improving crack control at the upper surface of a deck is by the use of reinforcement fabric in the uppermost region of the panel in order to resist shrinkage change due to temperature. A small volume of steel welded wire fabric is typically used for this purpose. For best crack control reinforcement, in accordance with the present invention, fiber or fabric reinforcement materials should be placed as close to the upper surface as practicable, preferably no lower than about one-sixth of the total depth of the concrete panel. For bridge deck panels which are 7½ to 9 inches thick, this is typically less than 1½ inches from the surface.

Since it has been determined by the present invention that bridge structures, as they are presently being designed, are in fact being over-designed by the inclusion of excess flexural reinforcing material in the upper portion of the panel; and since it has been further determined that top flexural reinforcing material placement, in accordance with current practice, adversely affects corrosion resistance and crack formation; it has therefore now been discovered that the flexural reinforcing material in the top half of existing bridge deck panel structures can be entirely removed without reducing the strength of the panels below what is sufficient to meet the demands which they must be designed to meet. It has been determined that with flexural reinforcing material in only the lower half of a bridge deck panel, more than sufficient flexural strength for moment bending'stresses of the panel will be provided. It will be readily appreciated that the removal of the two top layers of flexural reinforcing material from the panel will result in substantial reductions in production steps and in the cost of materials and the overall cost of construction.

It is therefore now taught that bridge deck panels with a flexural reinforcing material re-bar matrix in only the lower half of the panel, in accordance with the practice of the present invention, and preferably substantially no flexural reinforcement material, in the upper half of the bridge deck panel have substantially improved durability. A bridge deck panel with the top portion of the deck panel constructed in accordance with the current teaching does not require an extra thickness of concrete cover, or of the other expensive prior art defensive measures, thus, simultaneously, achieving both great cost savings and improved panel durability.

Therefore, to achieve the foregoing and other objects, and in accordance with the purposes of the present invention, a new and improved concrete panel design for use as a bridge deck panel in a bridge structure, or the like is disclosed. The panel design includes at least one layer of concrete which has flexural reinforcing material disposed only within about the lower half, and preferably in the lower one-third to about one-sixth of the concrete panel. The flexural reinforcing material may be even lower if the applicable codes will allow it. In preferred embodiments, a minimum of reinforcement material, such as fiber or fabric may be disposed in the panel, preferably in about the upper one-third to one-half portion of the concrete layer to provide control of cracking due to temperature change and concrete shrinkage.

In an alternative embodiment, a small amount of widely spaced flexural reinforcing bars, preferably oriented in the longitudinal direction, may be used in the upper half of a panel to reduce surface cracking from temperature change and concrete shrinkage.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE DRAWINGS

Figure 1:
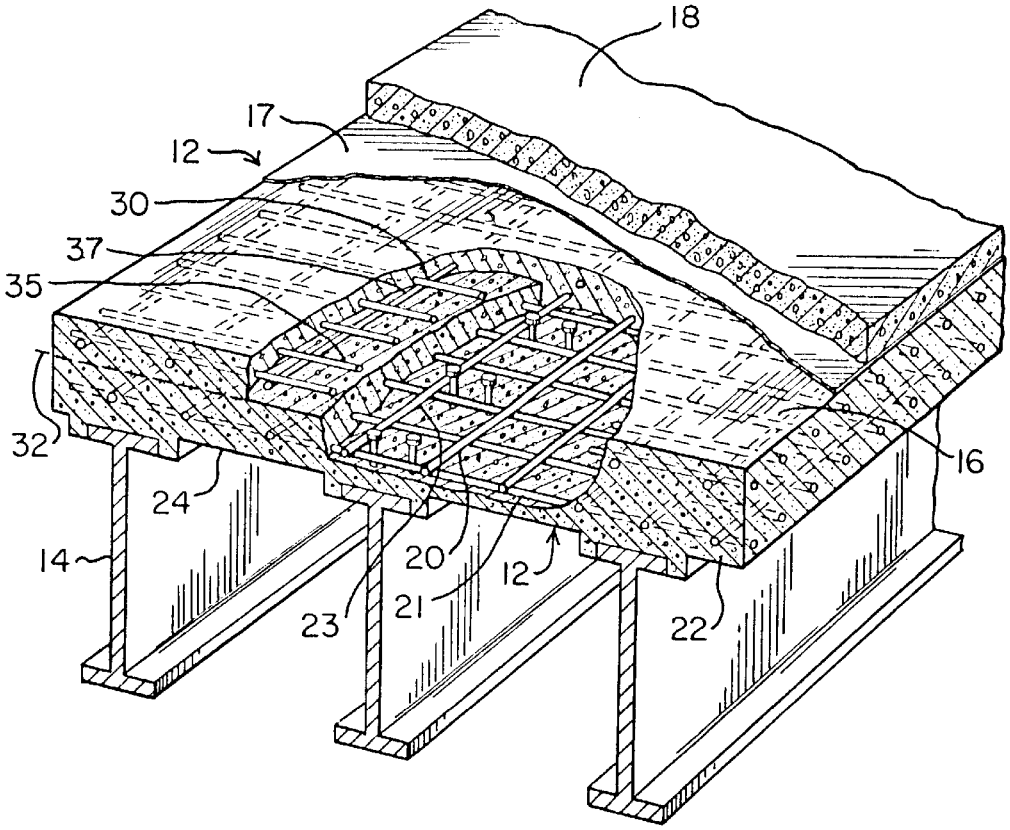
FIG. 1. PRIOR ART
FIG. 1 is a front perspective schematic cut-away view, partially in phantom, of a typical prior art bridge deck panel supported on girders, showing the structure of the deck panel with flexural reinforcing material in both the upper and the lower half of the panel.

Referring first to FIG. 1, a portion of a state-of-the-art bridge structure, generally 10, is illustrated in a front perspective schematic cut-away view,-partially in phantom. Bridge structure 10 includes a concrete bridge deck panel 12 supported by and continuous over beams 14 which are normally spaced between six and ten feet apart. Bridge deck panel 12 includes a top surface 16 and a bottom surface 24. In the traditional art, the thickness of bridge deck panel 12 is generally at least six inches, and preferably at least 6.5 inches. An optional waterproofing membrane 17 is shown as overlying top surface 16 of panel 12. Waterproofing membrane 17 is used to protect bridge deck panel 12 from the intrusion of corrosive solutions. Waterproofing membrane 17 is then overlain by wearing course 18 which is intended to come into contact with loads, such as vehicle traffic, which traverse panel 12 and bridge structure 10. For purposes of discussion, panel 12 may be considered as having a concrete layer 22 separated into an upper half 28 and a lower half 29 by a plane 32.

In this prior art bridge structure 10, two groups of flexural reinforcing materials, in this case in the form of matrices of steel reinforcing bars, are located in concrete panel 12, one in the upper half 28 and one in lower half 29. Lower group 20 of flexural reinforcing materials is below plane 32, closely adjacent to bottom surface 24 in lower concrete half 29. Lower group 20 of flexural reinforcing materials includes a lower layer of flexural reinforcing bars 21 which are oriented transverse to the longitudinal direction of panel 12, and an upper layer of longitudinal flexural reinforcing bars 23 which are oriented longitudinally, that is in the same direction as the longitudinal direction of panel 12. Layer 21 of flexural reinforcing bars are provided to resist positive transverse flexural moments which are applied to panel 12. Layer 23 of flexural reinforcing bars are provided to resist longitudinal positive flexural moments which are applied to panel 12. This lower group 20 of flexural reinforcing materials 21 and 23 also acts to control temperature and shrinkage crack formation in bottom surface 24. Flexural reinforcing bars 21 and 23 form bottom reinforcing mat 20.

An upper group 30 of flexural reinforcing materials is above plane 32, closely adjacent to upper surface 16 in upper concrete half 28. Upper group 30 of flexural reinforcing materials includes an upper layer of flexural reinforcing bars 35 which are oriented transverse to the longitudinal direction of panel 12, and a lower layer of longitudinal flexural reinforcing bars 37 which are oriented longitudinally, that is in the same direction as the longitudinal direction of panel 12. Layer 35 of flexural reinforcing bars are provided to resist positive transverse flexural moments which are applied to panel 12. Layer 37 of reinforcing bars are provided to control temperature and shrinkage cracking in upper surface 16, and to maintain alignment of bars 35 during concrete placement. Flexural reinforcing bars 35 and 37 form a top reinforcing mat 30 in the upper half of panel 12 which in fact, normally provides more flexural strength to panel 12 than is necessary for the intended use of the panel.

For the purposes of this particular specification, the following terms are defined as follows:

1. "Longitudinal" is the direction of support beams 14 and of the normal flow of traffic along upper surface 16;
2. "Transverse" is the direction, along surface 16, which is at right angles to the longitudinal direction and also at right angles to support beams 14;
3. "Positive moment" (+M) causes tension on lower surface 24 of concrete panel 12; and
4. "Negative moment" (−M) causes tension in upper surface 16 of panel 12.
5. "Plain concrete",is structural concrete in which the concrete is designed to carry all the flexural tensile stresses and any reinforcing material, when present, is assumed not to carry any flexural tensile stress. A "plain concrete" structure is characterized as a structure whose maximum flexural strength is attained at the cracking load of the concrete. "Plain concrete" is also any concrete that does not meet the criteria for reinforced concrete.
6. "Flexural reinforcing" is material which is utilized in reinforced concrete and is designed to carry all the tensile bending stress on the reinforced concrete member while the concrete is assumed not to carry any tensile stress. Flexural reinforcing is provided in an amount and orientation such that the flexural strength of the member is not diminished after the concrete sets and cracks.

7. "Reinforced concrete" is concrete containing sufficient flexural reinforcing to meet the minimum requirements of the applicable design code for reinforced concrete. Generally, the required minimum amount of reinforcing assures that the flexural load-capacity of the reinforced concrete member is substantially greater than the flexural load at which cracking occurs As set forth above, and as now applied to FIG. 1, observations of current bridge structure, construction and degradation, disclose that longitudinal cracking and delamination over girders 14 is no more severe than longitudinal cracking and delamination at other areas of deck panel 12. It has also been observed that cracking in negative moment regions at the top of continuous spans is no more severe than cracking which occurs elsewhere. It has also been discovered that transverse cracks in upper surface 16 of deck panel 12 are much more prevalent than longitudinal cracks. The conclusion that can be reached from these observations and discoveries is that longitudinal tensile stresses due to continuity, dynamic effects and concrete shrinkage are more significant as a cause of transverse cracks in upper surface 16 of deck panel 12 than are transverse stresses. Similarly, the conclusion can be reached that transverse flexural stresses in the top which cause longitudinal cracks are not significant. However, current bridge deck panels, such as those illustrated in FIG. 1, are reinforced with both top and bottom flexural reinforcing materials oriented in the transverse direction of the panels. Consequently, this results in increased transverse cracking in upper surface 16 of deck panel 12 due to longitudinal stresses, with crack formation often occurring directly over upper transverse flexural reinforcing members 35. Such crack formation over upper transverse flexural reinforcing members 35 subsequently provides a path by which layer 30, comprised of flexural reinforcing members 35 and 37 are exposed to thawing salt and other corrosion causing compositions which cause accelerated corrosion of those flexural reinforcing members, and as a result more deterioration of the panel and cracking of upper surface 16 which is detrimental to the structural strength of the panel and reduces its ability to support the superimposed loads. Therefore, the formation of transverse cracks directly over upper transverse flexural reinforcing bar members 35 is now seen to be a major problem in bridge deck panel deterioration.

Figure 2:
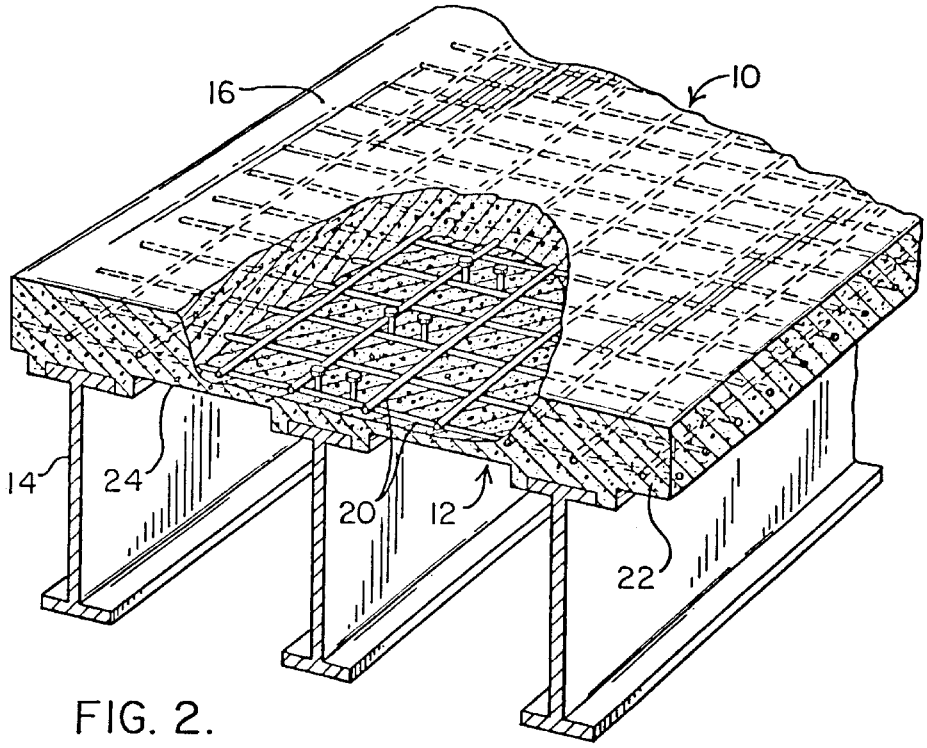
FIG. 2 is a front perspective schematic cut-away view, partially in phantom, of one embodiment of a bridge deck panel according to the present invention, supported on girders, showing the structure of the deck panel with flexural reinforcing material in only the lower half of the panel.

Referring next to FIG. 2, there is illustrated a front perspective schematic cut-away view, partially in phantom, of one embodiment of a bridge deck panel 12 according to the present invention, bridge structure 10. In FIG. 2 like numbers refer to the same elements as in FIG. 1. Bridge structure 10 includes a concrete bridge deck panel 12 supported by a plurality of spaced-apart, longitudinally aligned beam supports 14. Support beams 14 may be steel girders, webs of box girders, concrete girders or any other art known means to support a concrete deck panel structure. For purposes of discussion, panel 12 may be considered as being separated into an upper half and a lower half 29, as in FIG. 1. Support beams 14 are in turn transversely supported by art known bridge foundations (not illustrated), such as benches, piers and abutments. In normal usage, parapets (not illustrated) will be positioned along each of the longitudinal edges of bridge deck panel 12 to define a passageway for cars, trucks, and other traffic, as well as for pedestrians across or closely adjacent to upper surface 16. It should be noted; however, that bridge deck panel 12, as illustrated in FIG. 2, includes a matrix group of flexural reinforcing bar materials 20 embedded only in the lower half 29 of the panel juxtaposed to bottom surface 24 of deck panel 12, but that it includes no flexural reinforcing bar materials in the upper half of panel 12.

Referring more specifically to the preferred embodiment of the invention which is disclosed in FIG. 2, it will be noted that it completely eliminates steel flexural reinforcing bars from the top half of panel 12. So, for example, given a panel having a thickness of about eight inches (20.3 cm) about four inches (10.2 cm), or the upper half 28 of the bridge deck panel 12, whichever is greater, includes no ,steel flexural reinforcing bars. This is in sharp contrast to the current practice, illustrated in FIG. 1, of placing large flexural reinforcing bars in the top half of a given panel 12 also having a thickness of about eight about inches (20.3 cm), in the upper half about two inches (5.1 cm) or more below top surface 16, which practice has in fact been found to significantly increase the severity of cracking and concrete shrinkage cracking at top surface 16. In order to meet the minimum flexural reinforcing requirements, the minimum volume of steel flexural reinforcing in the upper half of the panel would generally be greater than about 1.0% by volume of the upper, half of the panel. Thus, as discussed above, while the use of flexural reinforcing bars in the upper half of a panel normally provides more flexural strength to panel 12 than is necessary for the intended use of the panel, the presence of flexural reinforcing bars in the upper half aggravates the problem of cracking due to temperature changes and concrete shrinkage, which in turn further aggravates due to underlying corrosion, with the result that cracking and deterioration of the panel is accelerated by the presence of flexural reinforcing bars in the upper half of the panel. Therefore, in accordance with the present invention, as shown in FIG. 1, a concrete layer 22 is provided which includes standard flexural reinforcing materials, for example primary steel flexural reinforcing grid 20 or other flexural strength reinforcing material in the bottom half of bridge deck panel 12, with no flexural strength reinforcing material in the top half of panel 12, either between or over interior supporting members 14. In the most preferred embodiment, the upper mat 30 of flexural reinforcing material is eliminated from the upper portion of the deck panel and the structure relies substantially solely upon the concrete itself for thermal and shrinkage crack resistance.

Once the flexural strength reinforcing material has been excluded from the top half 28 of panel 12, in order to best control cracking at the top surface 16 due to concrete shrinkage, the concrete deck panel 12 should be constructed, at least at the upper half 28, employing: either a concrete formulation having concrete shrinkage volume change compensating properties and adequate tensile strength to resist stresses from temperature change and concrete shrinkage change; or fibrous reinforcement material uniformly distributed throughout top portion of deck panel; or reinforcement material for temperature and shrinkage reinforcement material such as closely spaced small diameter wires- or small diameter wire fabric.

Figure 3:
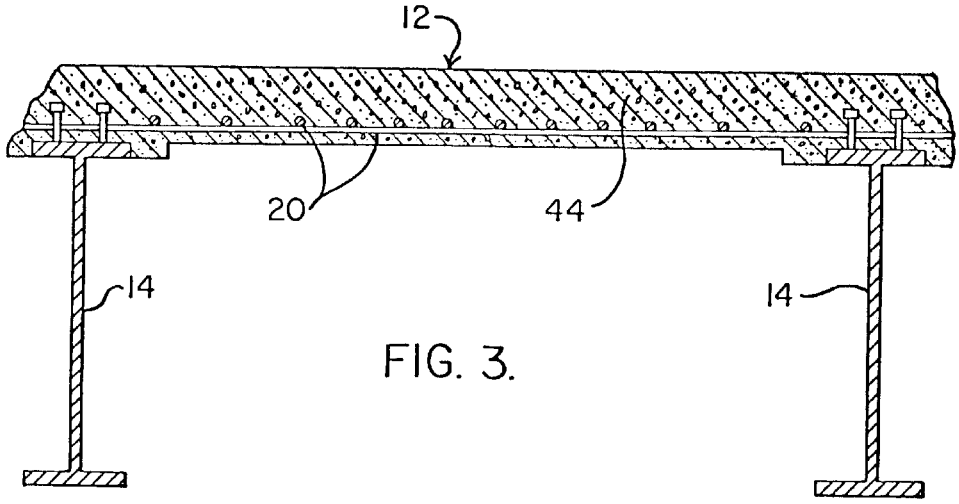
FIG. 3 is a cross-sectional schematic view of a deck panel of the present invention which is similar to the panel shown in FIG. 2.

Referring now to FIG. 3, there is shown a cross-sectional schematic view of deck panel 12, which is similar to the panel shown in FIG. 2. As illustrated it includes a concrete layer 44 having standard re-bar flexural reinforcing material 20 along the bottom portion thereof. In this particular embodiment the concrete composition of at least the upper half of concrete layer 44 is a plain concrete formulated to resist cracking from concrete shrinkage due to temperature change. The concrete in panel 12 of this example may be placed in one or more layer. Crack formation due to concrete shrinkage from temperature change can also be controlled and minimized by other art known methods of controlling the concrete composition, including the selection of size and type of course aggregate, water-cement ratio, cement-aggregate ratio, cement type, concrete placing sequence, and cement curing methods. Therefore, it is key to the embodiment of FIG. 3 to have adequate tensile strength of the concrete mix for layer 44 to avoid cracking due to temperature change and concrete shrinkage, and/or to select a concrete mix formulation and/or placement practice, and/or curing practice that minimizes shrinkage volume changed.

Figure 4:
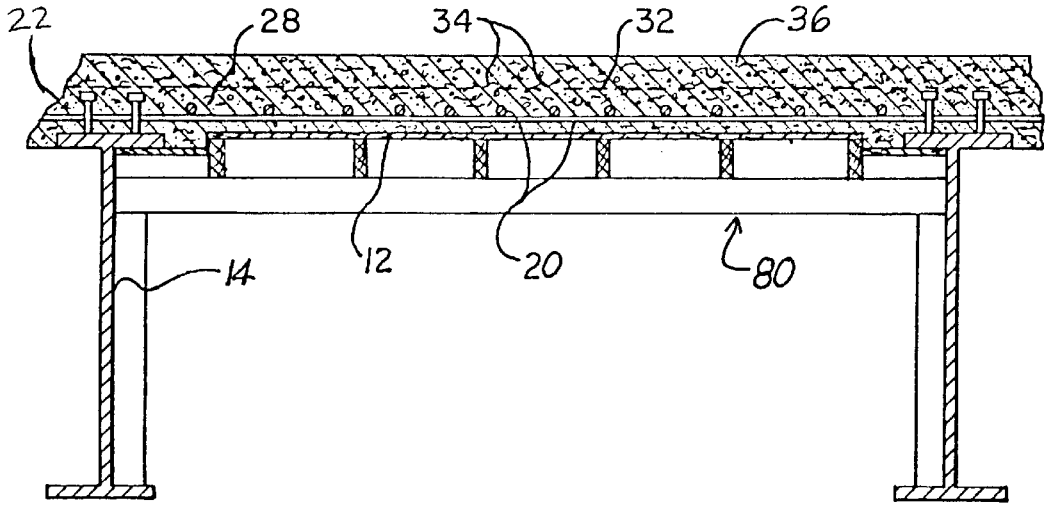
FIG. 4 is a cross-sectional schematic view similar to FIG. 3 and illustrating a second embodiment of the present invention, including fibrous reinforcement material in the concrete.

Referring now to another preferred embodiment as illustrated in FIG. 4, a typical cross section of a bridge deck panel 12 is illustrated showing a layer of concrete 22 having a matrix of standard bottom deck panel flexural reinforcing re-bar 20 in the lower half 29 thereof. FIG. 4 further illustrates an embodiment of the present invention wherein the concrete includes a fibrous reinforcement material 34 uniformly distributed throughout. In other embodiments the concrete may include fibrous reinforcement material distributed throughout only the upper half 36, and preferably in only the upper 40% as indicated by line 32. The fibrous concrete comprising layer 36 or entire layer 22 shall be a plain concrete in that the strength of the concrete after cracking is less than the strength prior to cracking.

The fibrous reinforcement materials are preferably made from steel polymeric materials, such as polypropylene, or other material suitable for use in a high-alkaline and salt saturated environment. The volume of fiber which is used should be sufficient increase the cracking modulus of the concrete matrix up to about 750 psi. The percentage of fiber reinforcement required to provide that amount of effective crack control will depend upon the physical and geometric properties of the fibers. For structures exposed to de-icing chemicals, ACI (American Concrete Institute) recommends the flexural crack width not be allowed to exceed 0.007 inch (0.018 cm). The limiting width for temperature and shrinkage cracks might appropriately be less than this, but certainly should not exceed the allowable crack width for structures exposed to weather, which is 0.012 inch (0.03 cm). Therefore in the practice of the present invention it is recommended that the temperature volume change crack control reinforcement limit crack width to the range of about least 0.005 inch (0.013 cm) to about 0.01 inch (0.025).

When fibers are used without any other measures to control temperature and shrinkage cracking, this may be accomplished by using fibrous reinforcement material of from about 0.3% to about 4%, by volume, within the top one-half of deck panel 12. Polypropylene fibers are frequently used as an additive to concrete to aid finishing and control of plastic shrinkage cracking in concentrations of only 0.1% to 0.2% by volume. A greater percentage of fibers is required to provide drying shrinkage crack control. For example, the percent volume of steel fiber reinforcement necessary for temperature and shrinkage crack control is usually in the range of 0.3% to 0.8% by volume and is usually most preferably less than 1%, but may be as much 2% or greater. Fibrous reinforcement materials such as steel fibers coated with polymer, or stainless steel or polymeric materials are desirable because they avoid corrosion. These, and other non-corrodible fiber reinforcement materials for concreted, are commercially available. In low concentrations, in accordance with the practices embodied in this invention, even normally corrodible fibers are not thought to cause detrimental corrosion, that is corrosion that reduces the structural integrity of the panel. The art of fiber reinforced concrete is well known and described in the section "Fiber Reinforced Concrete", *Manual of Concrete Practice* ACI.

Figure 5:
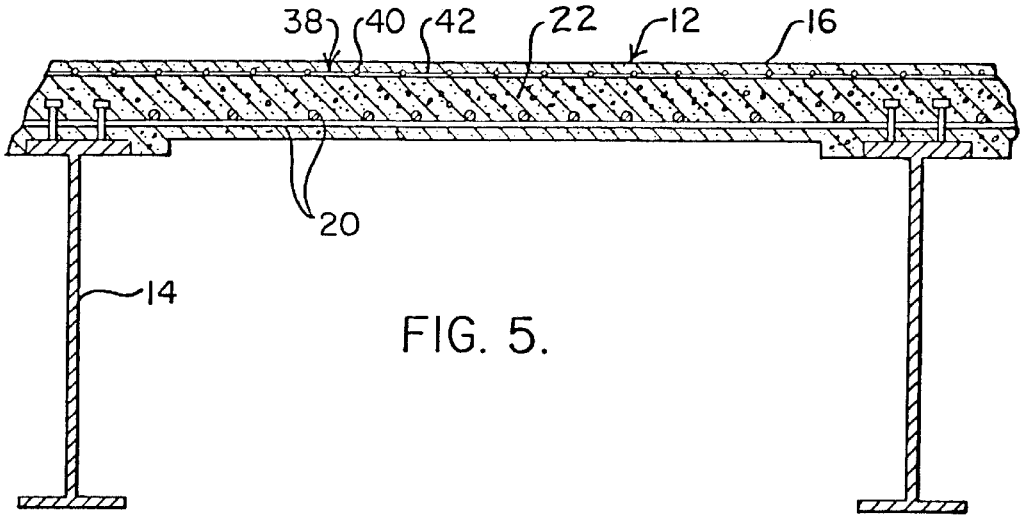
FIG. 5 is a cross-sectional schematic view similar to FIGS. 3 and 4 and illustrating yet a third embodiment of the present invention, including woven wire reinforcement material in the concrete.

Referring to FIG. 5, deck panel 12 is illustrated supported on beams 14 and includes a concrete layer 22 having standard bottom flexural reinforcing bars 20 as discussed previously. FIG. 5 further illustrates another embodiment of the present invention wherein reinforcement material for temperature shrinkage crack control purposes is provided in the upper portion of concrete layer 22. In this instance the reinforcement material is a welded wire fabric 38. Wire fabric 38 is comprised of longitudinally arranged wires 40 and transversely arranged wires 42. In this preferred embodiment wires 40, 42 would normally be less than about 0.3 inch (0.76 cm) in diameter, and are preferably equally spaced in both the longitudinal and transverse directions so as to control the temperature change cracking and concrete shrinkage cracking at upper surface 16. The cross sectional area of the fabric should conform to the current code recommendations for temperature and shrinkage reinforcement, that is 0.11 square inch per foot width in each direction. This provides a total volume of steel wire reinforcement in the upper half of less than about 0.5% which is substantially less then the minimum amount of reinforcing-necessary in the upper half to meet the requirements for "reinforced concrete". Wire spacing should not exceed the thickness of panel or overlay. In one preferred form, wire spacing may vary between about two and about six inches (5.1 and 15.3 cm). To control placement of welded wire fabric in the top one inch of concrete, which is the most preferred embodiment, wire fabric should be pressed into concrete from the surface thereof. The fabric 38 should be placed no closer to surface 16 than three times the diameter of individual wires 40 and 42, which will normally be between about ¾ inch and one inch from top surface 16 of deck panel 12. If steel wires of different diameters are provided in each direction, the ratio of the areas should be approximately proportional to the ratio of the length to width of the panel, with the larger cross-sectional area per unit width wire running in the longer dimension.

Web 38 may be composed of synthetic fabric in lieu of a steel fabric as discussed above, but the tensile force capacity per unit width should provide at least that of the type of steel fabric previously specified. The maximum cross-sectional area of the synthetic fabric used should be at least in proportion to the ratio of Young's modulus of the synthetic material to Young's modulus of steel. The equivalent cross-sectional areas, texture, openings and the distance from the surface and spacing requirements as specified for a steel fabric should also be met by such a synthetic fabric. Further, the synthetic fabric should provide the same recommended temperature and shrinkage crack control as are required of reinforcement fibers, and described above.

Panel placement as illustrated in FIGS. 3, 4 and 5, may be continuous and monolithic, or it may be placed in discontinuous sections, separated by vertical bulkheads to control concrete shrinkage strains. Panel placement may also be in discontinuous vertical lifts to reduce the quantity and cost of temperature change and concrete shrinkage crack resistant concrete used. Proper curing and bonding at the interface between placements must also be maintained.

Figure 6:
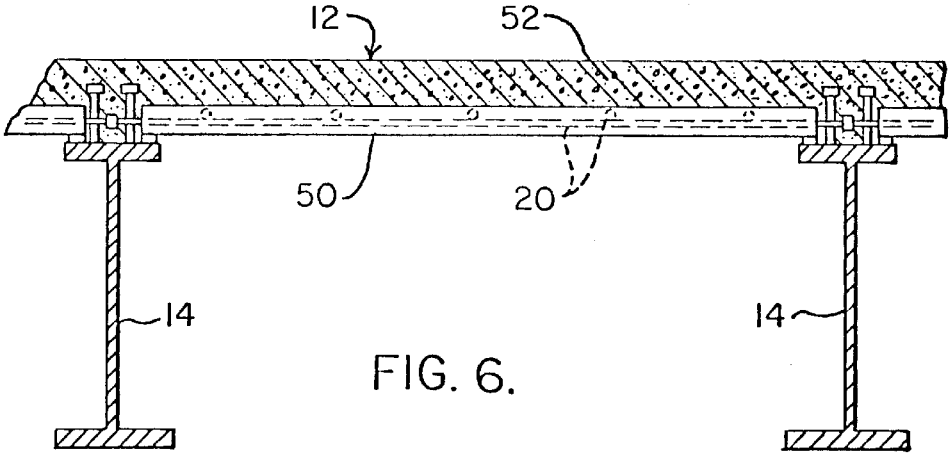
FIG. 6 is a cross-sectional schematic view similar to FIGS. 3, 4 and 5 and illustrating an embodiment of the invention which is useful with pre-cast panel structures.

Referring now to FIG. 6, there is illustrated a structure showing how the present invention may be utilized in conjunction with pre-cast concrete deck panel systems. In this embodiment, of deck panel 12, pre-cast lower or bottom concrete panels 50 are shown supported on and between girders 14. Pre-cast panels 50 include flexural reinforcing members 20 incorporated therein. Once pre-cast panels 50 are placed and interconnected into position on girders 14, a continuous cast-in-place concrete topping 52 comprised of a plain concrete which may include fibrous reinforcement or welded wire fabric, as described above, may then be positioned over pre-cast panels 50. In this manner, pre-cast panels 50 can be constructed in accordance with required flexural strength requirements of the particular bridge system being designed, and concrete top layer 52 may be placed over the pre-cast concrete without having to provide additional reinforcing material, other than as may be designed for use as for concrete shrinkage or thermal crack control purposes.

Figures 7A, 7B:
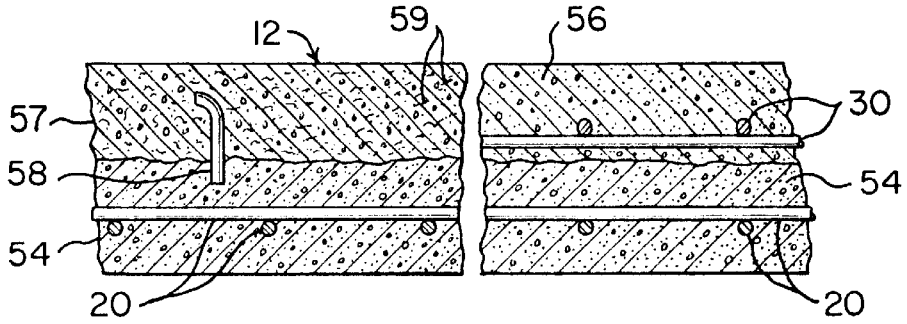
FIG. 7b. FIG. 7a. PRIOR ART
FIG. 7A is an enlarged cross-sectional schematic view of a typical prior art bridge deck panel, similar to the panel shown in FIG. 1, positioned for comparison with FIG. 7B.
FIG. 7B is an enlarged cross-sectional schematic view of a deck panel structure, including fibrous reinforcement material in the upper half of the concrete, similar to FIG. 4 of the present invention, as utilized for refurbishing existing bridge panel structures.

Referring to FIG. 7B, the present invention may also be utilized in refurbishment of existing bridge deck panels. In this instance, bottom portion 54 of bridge deck panel 12, including its original flexural reinforcing members 20, is retained in place, while the prior upper layer 56 and upper mat of flexural reinforcing 30, as shown in FIG. 7A, are removed. In this case it is assumed that the upper layer of -concrete 56 was chloride contaminated and the upper mat 30 of flexural reinforcing material was corroded and causing cracking, spalling and delamination of bridge deck panel 12, thus establishing the need to remove concrete 56 and upper re-bar mat 30 and refurbish deck panel 12. Remaining bottom portion 54 remains intact includes existing re-bar flexural reinforcing structure 20 and is substantially free of chloride contamination. A continuous cast- in-place plain concrete topping 57 is then be placed over remaining layer 54, with anchor bolts 58 being provided as required to assist the bonding of new concrete layer 57 to original layer 54. As can be seen in FIG. 7B, fiber reinforcement material 59 is dispersed throughout new upper layer 57 in accordance with the teaching of the present invention, as described above. Moreover, welded wire fabric or specially formulated concrete may also be utilized in layer 57 in accordance with the details set forth above. Fiber reinforcing materials or welded wire fabric, when used to assist in shrinkage and temperature change crack resistance, are in a quantity so as not to meet the requirements for "flexural reinforcing".

The side-by-side comparison of FIGS. 7A and 7B are also useful in contrasting the difference in the basic structure of the prior art panel and the panel of the present invention. In the prior art panel 12, as shown in FIG. 7A, the flexural reinforcing members 30 are present in upper half 28. In the present invention, as represented by FIG. 7B, there are no flexural reinforcing members in the upper half of panel 12, and yet the utility of such panels is not lost, and which, in fact, exhibit improved durability and resistance to deterioration.

Figure 8:
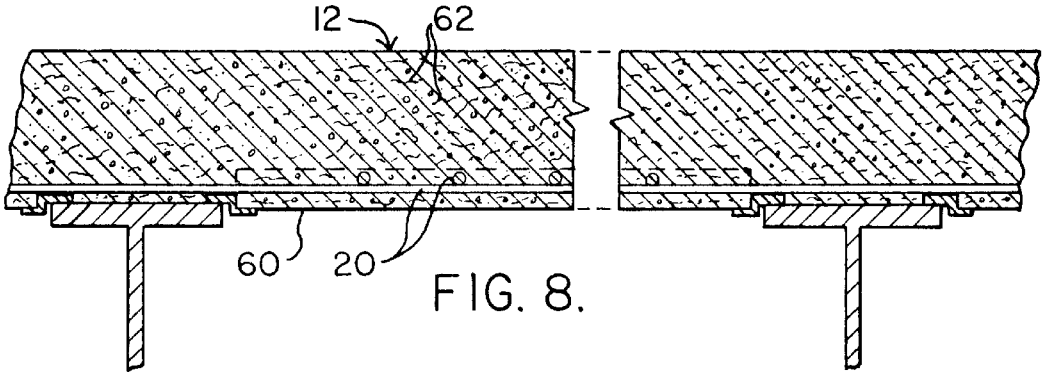
FIG. 8 is an enlarged cross-sectional schematic view similar to FIG. 3 illustrating yet another embodiment of the present invention.

Referring to FIG. 8, the present invention may also be utilized with a structural steel deck panel 60, which is commonly known as a "stay-in-place" form. In this embodiment structural steel deck panel 60 is used in conjunction with standard lower half flexural reinforcing re-bar matrix 20. Once structural steel deck panel 60 is laid in place in conjunction with flexural reinforcing 20, concrete, for example including fiber reinforcement 62 is then laid over deck panel 60 and flexural reinforcing re-bar matrix 20. The steel deck panel 60 may be constructed and positioned in accordance with art known bridge construction techniques.

Figure 9:
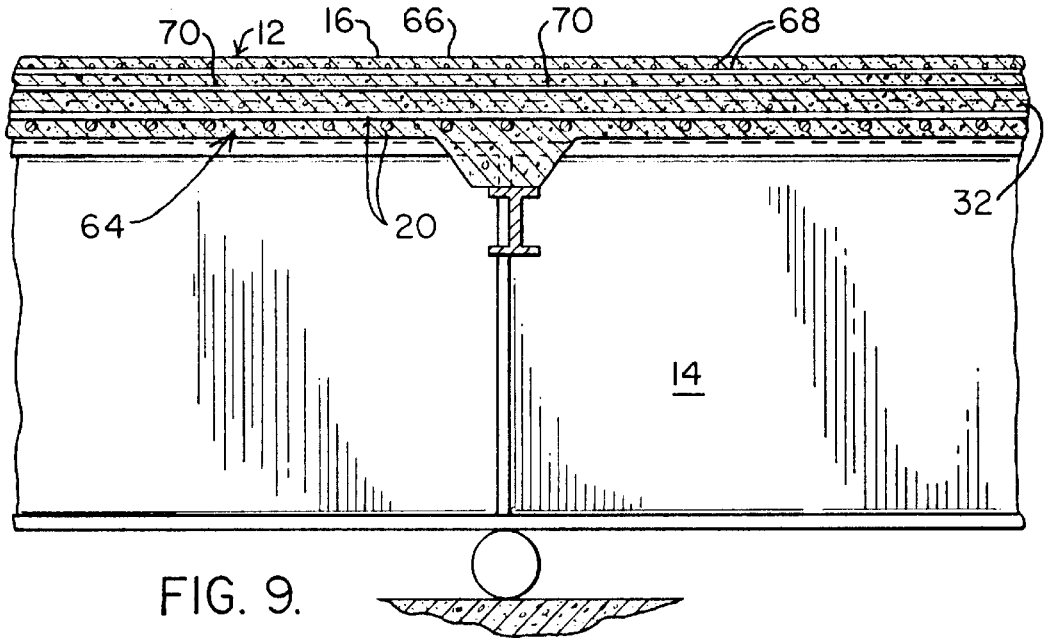
FIG. 9 is a longitudinal schematic view, partially in cross-section of a bridge deck panel structure illustrating an embodiment of the present invention which is useful in portions of the concrete bridge deck panel which are in the vicinity of a support, in which the bridge superstructure is continuous over such a support.

Finally, FIG. 9 illustrates an embodiment of the invention wherein the panels are utilized in the construction of a continuous bridge. In this instance, lower half 64 of beck panel 12 includes a lower matrix of standard flexural reinforcing re-bars 20 as previously discussed. Upper layer 66 is shown include wire web 68 which is utilized as, reinforcement to restrain cracking of upper surface 16 from concrete shrinkage or due to thermal changes. The wire web 68 is used for temperature and shrinkage crack control and the volume of such wire web fabric shall preferably be less than that required for "flexural reinforcing". Upper layer 66 is also shown as including additional longitudinal flexural reinforcing bars 70 in the upper portion of panel 12 overlying support beam 14. Top longitudinal flexural bars 70 are placed to provide additional reinforcement to restrain cracking in the deck from bending moments in the bridge. However, it is important to the present invention to note that there are no transverse flexural reinforcing bar located in upper half 66. Flexural reinforcing bars 70 should be approximately 2 inches or more below top surface 16, as in present bridge construction practice. Top longitudinal flexural bars 70 are placed to restrain cracking in the deck from bending moments in the bridge when the concrete deck is designed to act compositely with girders 14. Because the rate of change of stress in concrete is dependent on the total depth of the panel plus girder, effective crack control will normally be obtained when flexural reinforcing bar 70 is placed no further from top surface than about 5% to about 10% of the total depth of the panel and supporting girders or beams 14. Transverse bars, below bars 70 but not shown, are utilized solely for spacing and maintaining position of bars 70 during concrete placement. Bars 70 and 71 are not considered deck reinforcement. As with the practice described above, this embodiment may also include special concrete formulations and practice fiber reinforced concrete or fabric embedded in the upper half of the concrete.

The present invention also simplifies the process of constructing bridge deck panels. State-of-the-art bridge deck panel construction processes, utilizing traditional techniques, are formed in place on primary girders which provide longitudinal support. A bridge deck panel is constructed using the steps of installing either permanent or removable forming and falsework for shoring and bracing necessary to support the concrete bridge deck panel, shown generally as 80 in FIG. 4. Next, chairs or supports for the lower flexural reinforcing matrix are positioned. Then, the lower flexural reinforcing matrix is placed upon chairs and tied together in accordance with standard construction and detailing practices and the supports for the upper flexural reinforcing matrix are positioned. These supports are known as "high chairs" or "beam bolsters". After the chairs which support the upper flexural reinforcing matrix are placed, then an upper flexural reinforcing matrix is installed. Then concrete material is placed in the forms, finished, and cured, thereby providing a structural bridge deck panel. Finally, an optional concrete overlay or membrane system, for example with a bituminous wearing surface, is installed. Falsework and removable portions of the forming are removed after the concrete has obtained sufficient strength.

An alternative to this traditional method of making concrete bridge deck panels on multi-beam bridge superstructures, is to first place pre-fabricated deck panels between and/or over supporting beams. Then soffit forms and soffit reinforcing are installed as required, followed by the installation of supports for an upper flexural reinforcing matrix. The upper flexural reinforcing re-bar matrix is then installed, the concrete material is placed, and then cured and finished as previously described.

The improved process to which this invention applies considerably reduces both the number of steps and the amount of materials necessary to construct a concrete panel which is suitable for supporting superimposed loads. The improved process of panel construction, according to the present invention, is applicable to both panels which are fully cast in place, as well as to panels which are cast to include pre-existing pre-cast concrete, which is cast to include pre-existing steel bridge deck material, and to the refurbishment of existing panels.

The process is applied to the construction of panels which are fully cast in place, in that the steps of placing primary longitudinal beams for bridge superstructure and of placing are forming and falsework, shoring, and bracing is the same as in the basic traditional process described above. The reinforcing chairs for the lower mat are also placed, as is the lower reinforcing bar mat as described in the basic process. The step of placing reinforcing chairs for the upper mat and the placement of the upper reinforcing bar mat, as described in the basic process, are eliminated, as are the materials for those chairs and mats. The concrete is then placed, finished and cured, as described in the previous process. The last step of removing falsework is then completed.

In the preferred method of the present invention, reinforcement materials such as fiber or fabric may be mixed with the concrete, or at least in the concrete used to form the top portion of the panel. Such fiber or fabric reinforcement means are intended for temperature and shrinkage crack control and not intended to be used as "flexural reinforcing" materials, but rather are used in a quantity such that the properties of the concrete remains "plain".

Another alternate for the improvement of the basic bridge deck panel construction process is to impress a reinforcement web fabric into the uppermost portion of the just placed concrete during the step in which concrete is placed shored and finished, as previously described, but prior; to finishing and curing. The wire web fabric reinforcement means is intended for temperature and shrinkage crack control and is not intended to be used as flexural reinforcing means. The wire web fabric is used in a quantity such that the properties of the concrete remains "plain".

Another alternate process to improved bridge deck panel construction is to place the concrete which is used to form the panel in multiple layers, so that a first layer of concrete placed, say up to approximately the middle of the full structural depth of the panel. Then, after the layer is properly cured, leaving the surface rough, a bonding material may be coated on the upper surface, and a second structural concrete overlay is installed to complete the full depth of the panel. This second structural concrete overlay may include a special concrete mix formulation with enhanced shrinkage and temperature characteristics, or it could include the use of fiber or fabric reinforcement in the upper portion of the upper placement of concrete, as previously described, for control of cracking due to temperature changes.

The processes embodied by this invention wherein alternate traditional methods of constructing bridge deck panels are used, are all significantly improved by deleting two steps, and by deleting the support chairs and flexural reinforcing materials associated with those two steps from the state of the art process for constructing such panels.

The improved bridge deck panel construction process using pre-cast or prefabricated deck panels includes positioning main super-structure supporting elements and longitudinal beams, and then installing prefabricated deck panel panels, as described in alternate basic bridge deck panel construction process. The soffit forms- and reinforcing are then installed, and structural concrete overlay is then placed, finished and cured, as described previously as an improvement to the basic bridge deck panel construction process described earlier. The step of placing reinforcing chairs for the upper mat and the placement of the upper reinforcing bar mat, as described in the basic process, are eliminated, as are the materials for those chairs and mats. The concrete is then placed, finished and cured, and then finally, the soffit forms are removed, if necessary.

The present invention also simplifies the process of rehabilitation existing bridge deck panels which have suffered extensive deterioration as a result of corrosion of the upper flexural reinforcing bar layer. State-of-the-art bridge deck panel rehabilitation techniques include complete removal and replacement, or installation of cathodic protection systems to arrest corrosion, or spot patching the deteriorated areas. The improved process to which this invention applies is removal of the upper layer of contaminated concrete and the corroding flexural reinforcing bars leaving the structurally intact lower layer of the bridge deck panel in place to support a new overlayer of structural plain concrete which has been formulated and installed employing practices which limit cracking from temperature change and concrete volume shrinkage. The improved process eliminates the primary cause of continued deterioration of the panel from corrosion of the upper reinforcing bar layer thereby providing greater durability to the panel. The improved process utilizes less materials and requires less labor to complete than the state-of-the-art process of complete deck replacement. The improved process provides a more durable panel requiring far less maintenance than either of the state-of-the-art methods of cathodic protection or patching.

It is therefore seen that the present invention provides a load bearing concrete panel which is significantly less expensive to produce then existing panels, yet which meets all requirements for flexural strength imposed on such panels when used in bridging structures. This is accomplished by the removal of about one-half of the flexural reinforcing materials which are used in state-of-the-art load bearing concrete panels, and further, which is easier and less labor intensive due to the elimination of the steps which are currently necessary to place the eliminated flexural reinforcing materials. Furthermore, this is accomplished without loss of the utility of such panels, and, in fact, with the resulting panels having improved durability. In other words, by the elimination of traditionally required flexural reinforcing material from the top half of the panel, which is believed to be the principal Source of panel deterioration, the present invention provides a concrete bridge deck panel structure which has sufficient flexural reinforcement to provide the appropriate amount of flexural strength, but which significantly impedes the amount and speed of deterioration of the surface of the deck panel. In preferred embodiments, a concrete bridge deck panel structure is provided in which structural flexural reinforcing material, such as steel reinforcing bars, are not required in the top half of the panel near the top surface of the panel. With the elimination of the flexural reinforcing material in the upper half, such as steel reinforcing bars, a concrete bridge deck panel structure is provided in which chlorides from thawing salts and other corrosive materials do not corrode re-bars in the upper half of the concrete panel, because there are none there to corrode thereby avoiding a source of significant cracking and deterioration of the top surface of the bridge deck panel. The present invention may be used in the design of concrete panels for use in new bridge construction and in rehabilitating existing bridge panel structures.

While the invention has been particularly shown, described and illustrated in detail with reference to preferred embodiments and modifications thereof, it should be understood by those skilled in art that the foregoing and other modifications are exemplary only, and that equivalent changes in form and detail may be made therein without departing from the true spirit and scope of the invention as claimed, except as precluded by the prior art.

The embodiments of the invention in which an exclusive property or privilege is claimed are defined as follows:

1. A load bearing concrete panel structure which is designed to be supported between at least a pair of separated support members, said panel structure being comprised of a concrete structure having a length dimension, a width dimension, and a height dimension, said concrete structure having an upper half having an upper surface which is designed to come into contact with or to be closely adjacent to loads which traverse said panel structure, and a lower half having a lower surface which is spaced from loads which traverse said panel structure, and wherein the improvement comprises:

said panel structure being produced from a shrinkage and temperature resistant concrete composition;

and which said upper half of said panel structure consists essentially of plain concrete, said plain concrete being a structural concrete in which said plain concrete carries all the flexural tensile stresses and which said plain concrete is characterized as a structural concrete whose maximum flexural strength is attained at the cracking load thereof, said plain concrete having a tensile strength less than about 750 pounds per square inch, and which said upper half, intermediate the two furthest separated support members, is free of flexural reinforcing means for carrying bending moment tension stresses in said panel structure, and wherein said lower half of said panel structure includes flexural reinforcing means for carrying bending moment tension stresses.

2. The concrete panel structure of claim 1 in which said flexural reinforcing means of said lower half of said panel structure is selected from the group consisting of metal rods and metal strands, and which said flexural reinforcing means is disposed within the lower one-third of said panel structure.

3. The concrete panel structure of claim 1 in which said flexural reinforcing means of said lower half of said panel structure is selected from the group consisting of metal rods, metal bars and metal strands, and which said flexural reinforcing means is below a plane that is no further than one-third the depth of said panel structure above said lower surface of said concrete panel structure.

4. The concrete panel structure of claim 1 in which said flexural reinforcing means in said bottom half of said panel structure comprises from at least about 1.0% by volume of said lower half of said panel structure.

5. The concrete panel structure of claim 1 in which said concrete structure for said panel structure is cast in two or more layers.

6. The concrete panel structure of claim 1 in which said concrete composition is specially formatted to resist or limit temperature and shrinkage volume change, and crack formation therefrom, in at least said upper half of said panel structure, by constructing said panel structure of concrete embodying practices of said panel structure selected from the group consisting of the use of temperature and shrinkage limiting concrete compositions, by concrete placement and curing means, by utilizing concrete compositions which set to form concrete resistant to temperature change and shrinkage strain cracking, by including shrinkage volume change compensating additives in concrete compositions, by employing staged panel placement, by employing structural measures which allow temperature and shrinkage volume change deformations to occur without restraint, and whereby said practices selected limit temperature and shrinkage volume changes and resist cracking which may result therefrom.

7. The load bearing concrete panel structure of claim 6 wherein said panel structure is used as decking material in a bridge structure, wherein said lower half of said panel structure includes flexural reinforcing means comprising from about at least 1.0% by volume of said lower half of said panel structure, said flexural reinforcing means being disposed no further from said lower surface than one-third said height of said panel structure, and wherein said plain concrete includes means to resist temperature and shrinkage volume change crack formation selected from the group of fibers, fabric or rods.

8. The concrete panel structure of claim 7 in which said means to resist includes fiber material means in an amount and distribution sufficient to substantially resist crack formation due to temperature change and concrete volume shrinkage of said panel structure.

9. The concrete panel structure as claimed in claim 1 in which said plain concrete of said upper half includes metal rods or metal wire web fabric for temperature and shrinkage crack control purposes in an amount and distribution sufficient to substantially resist crack formation at the top surface of said panel structure.

10. The concrete panel structure of claim 7 wherein the bridge is continuous over intermediate bridge supports and where said concrete panel structure includes longitudinal flexural reinforcing material that is disposed at least 2.0 inches below said upper surface of said concrete panel structure.

11. The concrete panel structure of claim 1 in which said concrete panel structure is constructed to resist or limit temperature and shrinkage volume change, and crack formation therefrom, in at least said upper half of said panel structure by constructing said concrete panel structure embodying practices of said panel structure selected from the group consisting of the use of temperature and shrinkage limiting concrete compositions, by concrete placement and curing means, by utilizing concrete compositions which set to form concrete resistant to temperature change and shrinkage strain cracking, by including shrinkage volume change compensating additives in concrete compositions, by employing staged panel placement, by employing structural measures which allow temperature and shrinkage volume change deformations to occur without restraint, by including fiber or fabric material in said concrete compositions as temperature change and concrete volume shrinkage crack resisting means, and whereby said practices selected limit temperature and shrinkage volume changes and resist cracking which may result therefrom.

12. The concrete panel structure of claim 11 in which said upper half of said panel structure includes said fabric material selected from the group consisting of metal wire, welded steel, metal wire coated with water resistant and corrosion resistant material, welded steel coated with water resistant and corrosion resistant material, and of polymeric material or reinforced polymeric material, and wherein said fabric is disposed not further than one inch below said upper surface of said panel structure and wherein said upper half remains substantially plain concrete.

13. The concrete panel structure of claim 11 in which said fiber material is selected from the group consisting of metal material present in an amount up to about 0.6% by volume of said upper half of said panel structure and of polymeric material present in an amount up to about 4% by volume of at least said upper half of said panel and wherein said structural concrete including fiber materials in at least said upper half is substantially plain concrete.

14. The concrete panel structure of claim 11 in which said concrete composition includes fibers in at least said upper half of said panel, said fibers comprising a mixture of metal fibers and of polymeric fibers and wherein said structural concrete including fiber materials in at least said upper half is substantially plain concrete having a tensile strength of less than about 750 pounds per square inch.

15. A load bearing concrete panel structure used as a decking material in a bridge structure and which is designed to be supported between at least a pair of separated support members, said panel structure being comprised of a concrete structure having a length dimension, a width dimension, and a height dimension, said concrete structure having an upper half having an upper surface which is designed to come into contact with or to be closely adjacent to loads which traverse said panel structure, and a lower half having a lower surface which is spaced from loads which traverse said panel structure, and wherein the improvement comprises:

said panel structure being produced from a shrinkage and temperature resistant concrete composition and in which said concrete composition is specially formatted to resist or limit temperature and shrinkage volume change, and crack formation therefrom, in at least said upper half of said panel structure, by constructing said panel structure of concrete embodying practices of said panel structure selected from the group consisting of the use of temperature and shrinkage limiting concrete compositions, by concrete placement and curing means, by utilizing concrete compositions which set to form concrete resistant to temperature change and shrinkage strain cracking, by including shrinkage volume change compensating additives in concrete compositions, by employing staged panel placement, by employing structural measures which allow temperature and shrinkage volume change deformations to occur without restraint and whereby said practices selected limit temperature and shrinkage volume changes and resist cracking which may result therefrom, and which said upper half of said panel structure consists essentially of plain concrete, said plain concrete being a structural concrete in which said plain concrete carries all the flexural tensile stresses and which said plain concrete is characterized as a structural concrete whose maximum flexural strength is attained at the cracking load thereof, said plain concrete having a tensile strength less than about 750 pounds per square inch, and which said upper half, intermediate the two support members, is free of flexural reinforcing means for carrying bending moment tension stresses in said panel structure, and wherein said lower half of said panel structure includes flexural reinforcing means for carrying bending moment tension stresses that comprises from about at least 1.0% by volume of said lower half of said panel structure, said flexural reinforcing means being disposed no further from said lower surface than one-third said height of said panel structure, and wherein said plain concrete of said upper half includes metal rods for temperature and shrinkage crack control purposes in an amount and distribution sufficient to substantially resist crack formation at said upper surface of said panel structure, said metal rods being comprised of a first plurality of said metal rods disposed in said upper half to form a first upper layer of metal rods having a first orientation which extends substantially in the length dimension of said panel structure and parallel to the support members, and a second plurality of said metal rods disposed in said upper half to form a second lower layer having a second orientation which extends substantially transversely to said first upper layer of metal rods.

16. The concrete panel structure of claim 15 in which said metal rods are coated with corrosion prevention material.

* * * * *